US007773039B2

(12) United States Patent
Shimo et al.

(10) Patent No.: US 7,773,039 B2
(45) Date of Patent: Aug. 10, 2010

(54) HIGH FREQUENCY WAVE ANTENNA FOR AN AUTOMOBILE

(75) Inventors: Kenichiro Shimo, Chiyoda-ku (JP); Kazuyoshi Noda, Chiyoda-ku (JP); Takuji Hayashi, Chiyoda-ku (JP)

(73) Assignee: Asahi Glass Company, Limited, Tokyo (JP)

( * ) Notice: Subject to any disclaimer, the term of this patent is extended or adjusted under 35 U.S.C. 154(b) by 30 days.

(21) Appl. No.: 12/169,136

(22) Filed: Jul. 8, 2008

(65) Prior Publication Data

US 2009/0027283 A1 Jan. 29, 2009

(30) Foreign Application Priority Data

Jul. 9, 2007 (JP) ..... 2007-179706

(51) Int. Cl.
*H01Q 1/32* (2006.01)
*H01Q 1/02* (2006.01)

(52) U.S. Cl. ..... 343/713; 343/704

(58) Field of Classification Search ..... 343/704, 343/713

See application file for complete search history.

(56) References Cited

U.S. PATENT DOCUMENTS 4,095,228 A 6/1978 Meinke et al.
7,420,517 B2 9/2008 Oshima et al.
2006/0152421 A1 7/2006 Baranski
2007/0109207 A1 5/2007 Mondadori et al.
2007/0247379 A1 10/2007 Oshima et al.

FOREIGN PATENT DOCUMENTS

EP 1 763 105 A1 3/2007
JP 2003-347812 12/2003
JP 2007-295536 11/2007
WO WO 2006/001486 A1 1/2006

OTHER PUBLICATIONS

U.S. Appl. No. 12/251,570, filed Oct. 15, 2008, Shimo, et al.

*Primary Examiner*—Michael C Wimer
(74) *Attorney, Agent, or Firm*—Oblon, Spivak, McClelland, Maier & Neustadt, L.L.P.

(57) ABSTRACT

A high frequency wave antenna for an automobile is provided, which improves antenna gain of an antenna conductor provided in a spoiler. A defogger is provided on a rear window glass plate 14, a part of a plurality of heater wires extend in a horizontal direction, a spoiler including an antenna conductor 6 embedded therein is provided above the rear window glass plate 14, at least one of a plurality of bus bars has a bus bar horizontal portion 1H extending in a horizontal direction, the bus bar horizontal portion 1H is provided in an upper region of the rear window glass plate 14, and a plurality of vertical heater wires 2 extending in a vertical direction from the bus bar horizontal portion 1H, are provided.

19 Claims, 8 Drawing Sheets

HIGH FREQUENCY WAVE ANTENNA FOR AN AUTOMOBILE

The present invention relates to a high frequency wave antenna for an automobile suitable to receiving Japanese terrestrial digital TV broadcasting (470 to 770 MHz), analogue TV broadcasting in UHF band (473 to 767 MHz) or U.S. digital TV broadcasting (698 to 806 MHz). Further, the present invention also relates to a rear window glass for an automobile on which a high frequency wave glass antenna for an automobile is provided.

Figure 2:
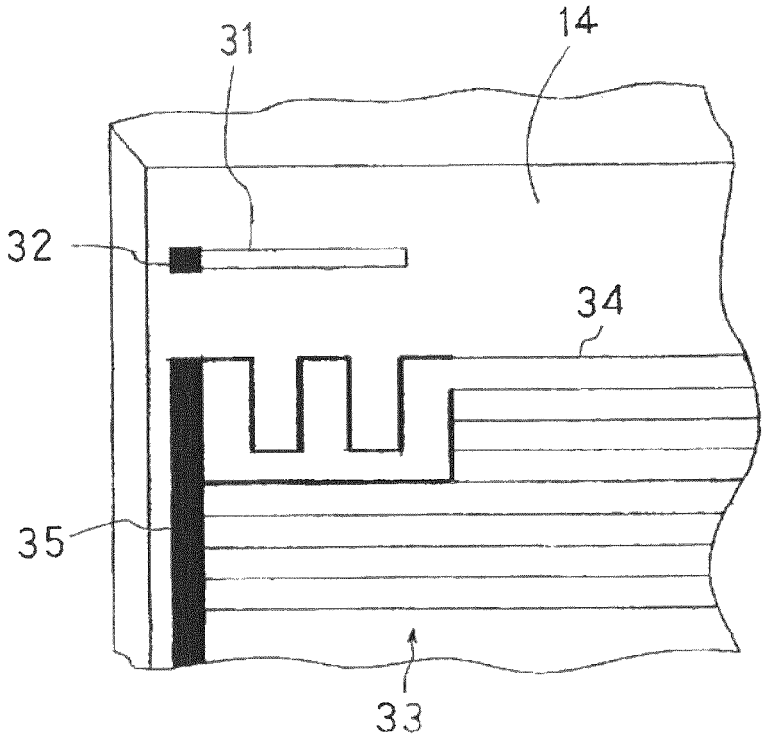

Heretofore, a high frequency wave antenna for an automobile to receive digital TV broadcast band wave shown in FIG. 2 is reported in WO2006/001486. In this prior art example, a defogger constituted by a plurality of heater wires 33 and bus bars 35 is provided on a rear window glass plate 14, and an antenna conductor 31 and a feeding point 32 is provided. A heater wire at the highest position right under the antenna conductor 31 has a meander shape. In this construction, in a digital TV broadcast band, influence of heater wires 33 and 34 to the antenna conductor 31 is reduced, and the antenna gain in the digital TV broadcast band is improved.

However, in this prior art example, since the heater wire 34 at the highest position has a meander portion and its length is longer than other heater wires, the line width of the heater wire 34 at the highest position needs to be wider to make the resistance of the entire heater wire 34 at the highest position equivalent to those of other heater wires, and accordingly, there has been a problem that the width of the heater wire 34 at the highest position prevents visibility.

It is an object of the present invention to provide a high frequency wave antenna for an automobile which solves the above-mentioned problem of prior arts.

The present invention provides a high frequency wave antenna for an automobile, comprising a plurality of heater wires and a plurality of bus bars for supplying electricity to the plurality of heater wires, the heater wires and the bus bars being provided on a rear window glass plate for an automobile, the heater wires and the bus bars constitute a defogger, a part of the heater wires extending in a horizontal direction or a substantially horizontal direction, and the antenna comprising an antenna conductor provided on an upper blank space of the rear window glass plate or in the vicinity of the rear window glass plate, the antenna being characterized in that at least one of the bus bars has a base bar horizontal portion extending in a horizontal direction or a substantially horizontal direction, the bus bar horizontal portion is provided in the upper region of the rear window glass, and a plurality of vertical heater wires extending in a vertical direction or a substantially vertical direction starting from the bus bar horizontal portion.

In the present invention, by employing the above construction, it is possible to reduce the influence of the defogger on the antenna performance of the antenna conductor, and to significantly improve antenna gain for the terrestrial digital TV broadcasting or the U.S. digital TV broadcasting etc. Further, since the line width of each of plurality of vertical heater wires in the present invention can be reduced, visibility of rear window, particularly, view field and beauty of defogger region are not deteriorated.

Figure 1:
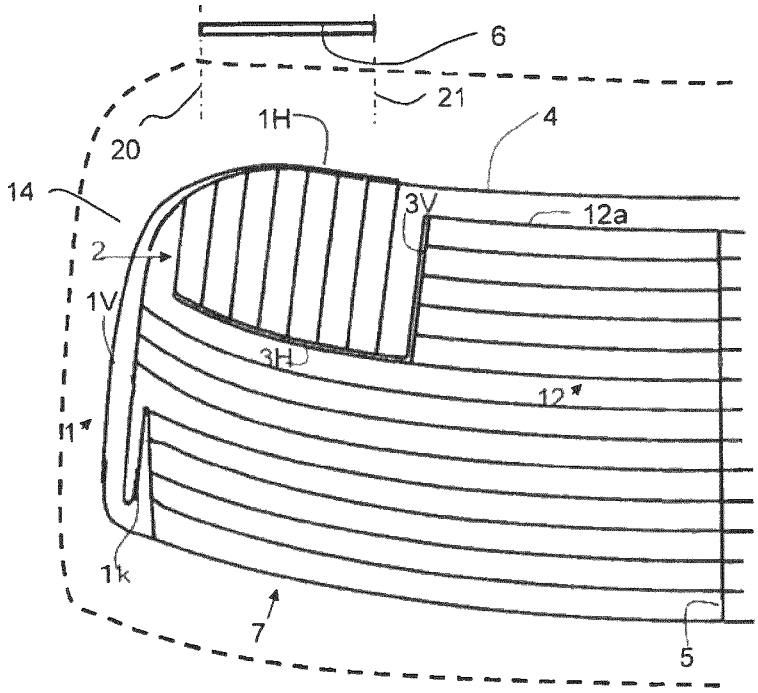

FIG. 1: A front view showing an embodiment of a high frequency wave glass antenna for an automobile of the present invention.

FIG. 2: A front view showing an example of prior art.

Figure 3:
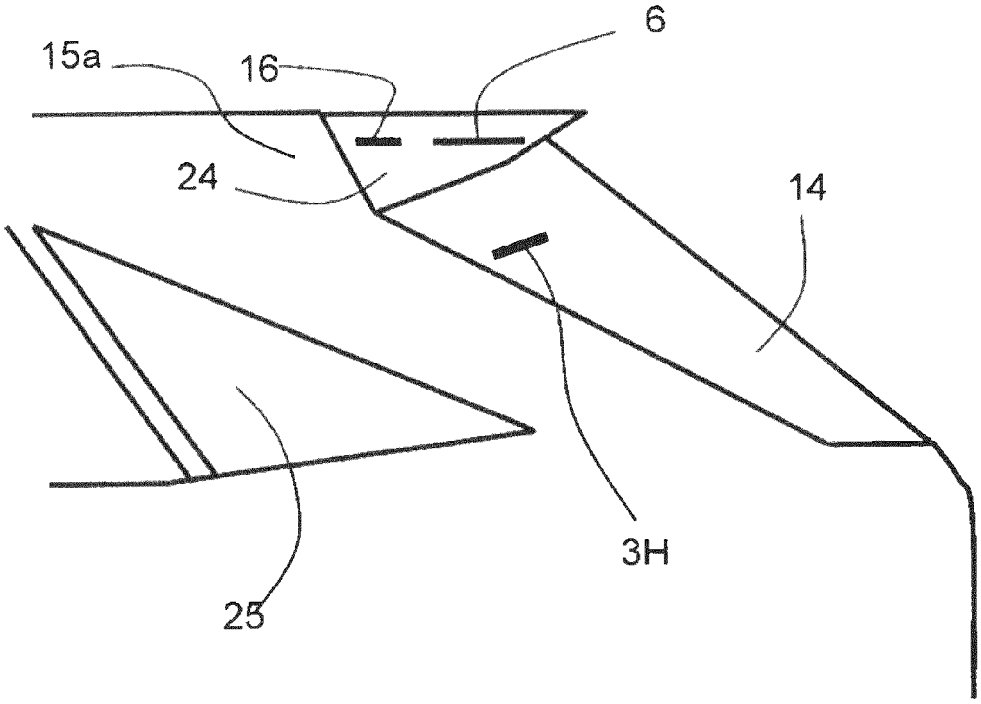

FIG. 3: A side view showing a side of rear upper portion of an automobile in an embodiment of the high frequency wave glass antenna for an automobile of the present invention (including the embodiment shown in FIG. 1).

Figure 4:
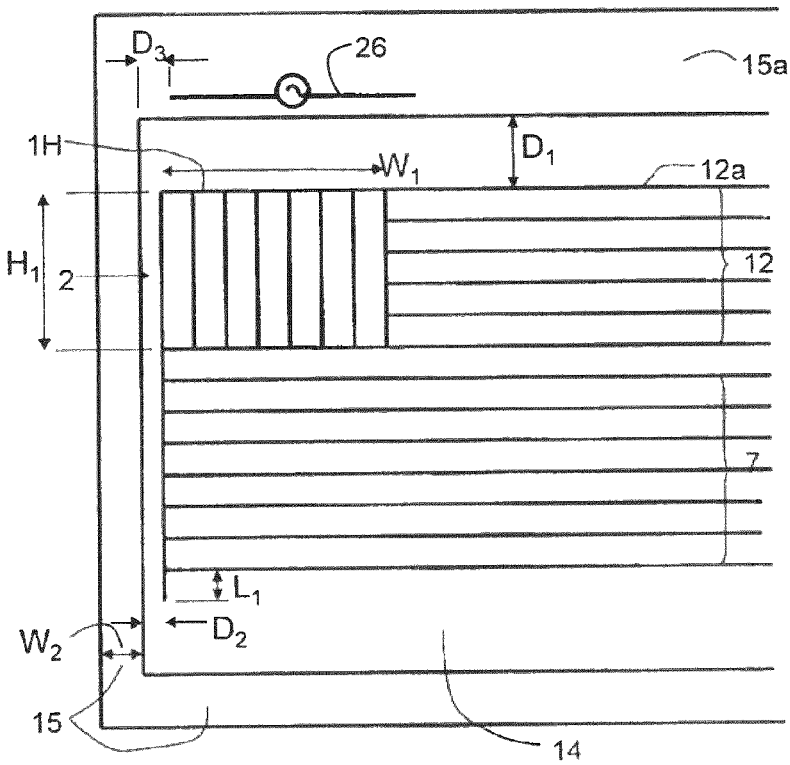

FIG. 4: A front view showing an upper left side half of the rear portion of an automobile in Examples 1 and 2.

Figure 5:
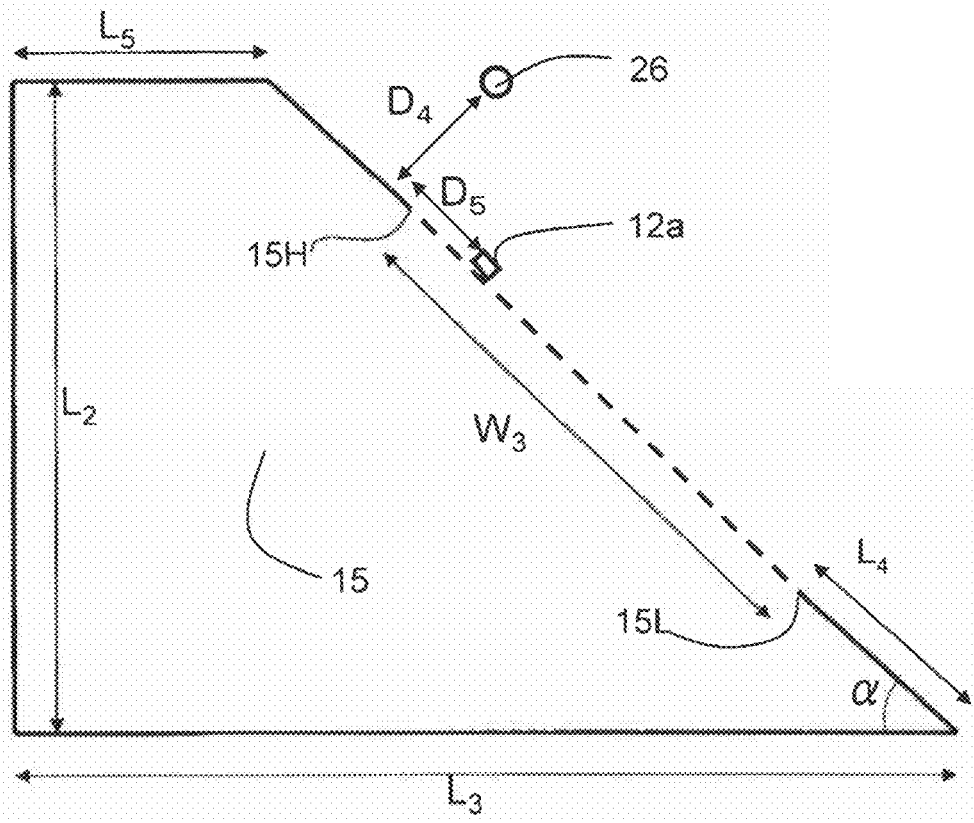

FIG. 5: A side view showing a high frequency wave antenna for an automobile shown in FIG. 4.

Figure 6:
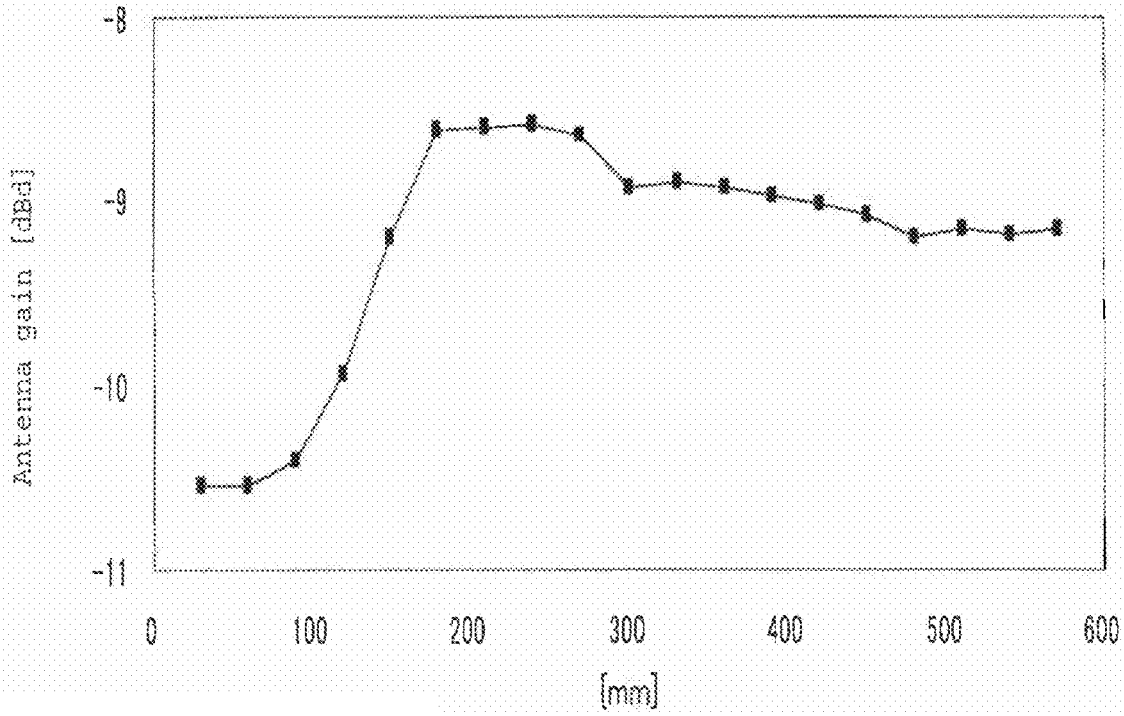

FIG. 6: An antenna gain-$W_1$ characteristic diagram (470 to 770 MHz) in Example 1.

Figure 7:
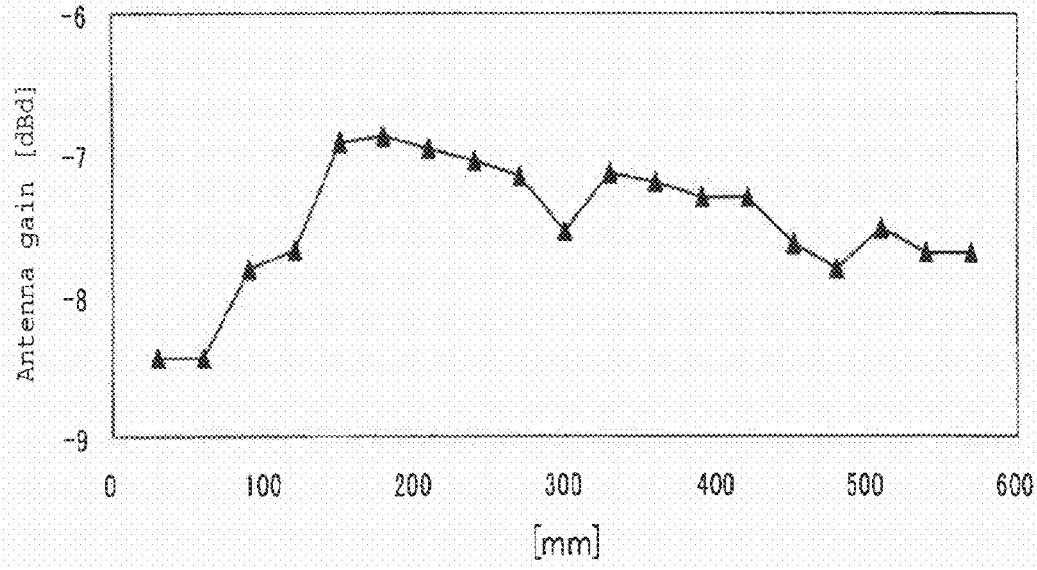

FIG. 7: An antenna gain-$W_1$ characteristic diagram (470 to 600 MHz) in Example 1.

Figure 8:
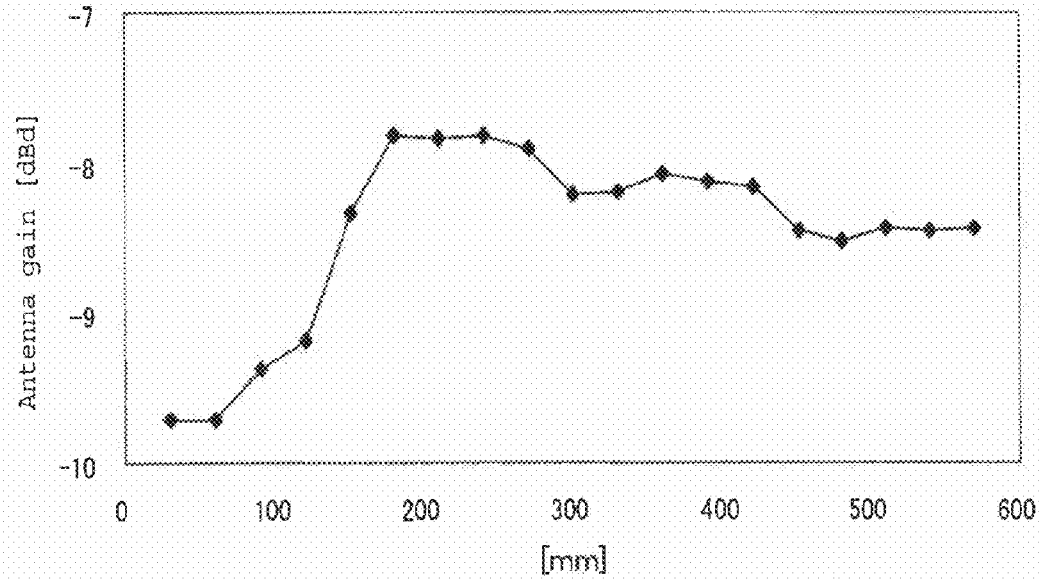

FIG. 8: An antenna gain-$W_1$ characteristic diagram (470 to 710 MHz) in Example 1.

Figure 9:
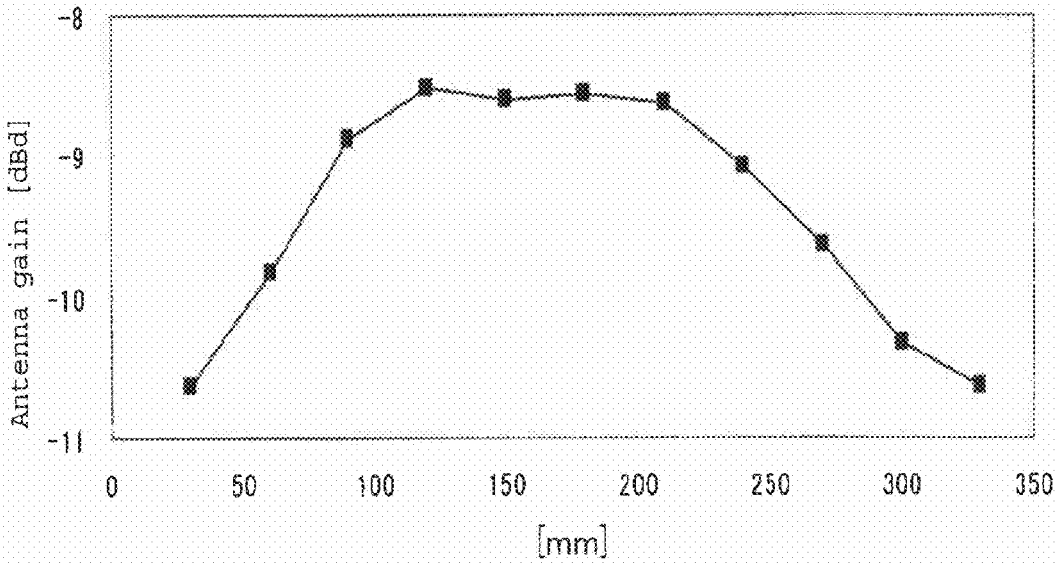

FIG. 9: An antenna gain-$H_1$ characteristic diagram (470 to 770 MHz) in Example 2.

Figure 10:
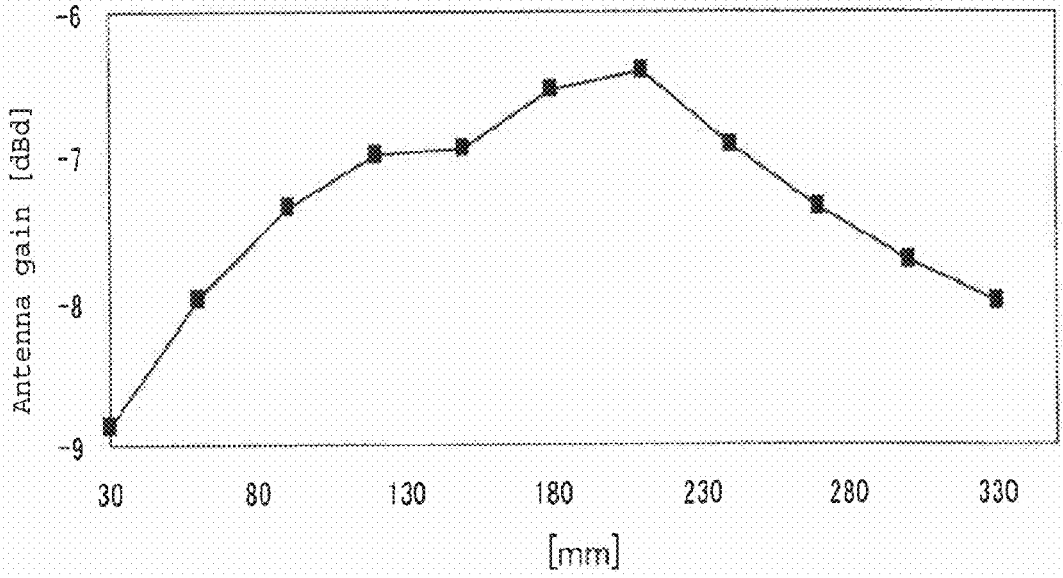

FIG. 10: An antenna gain-$H_1$ characteristic diagram (470 to 600 MHz) in Example 2.

Figure 11:
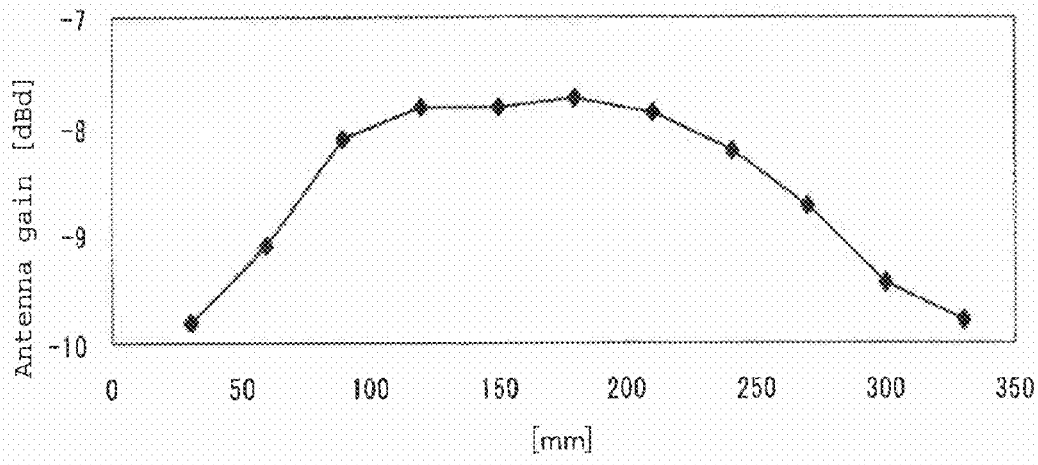

FIG. 11: An antenna gain-$H_1$ characteristic diagram (470 to 710 MHz) in Example 2.

Figure 12:
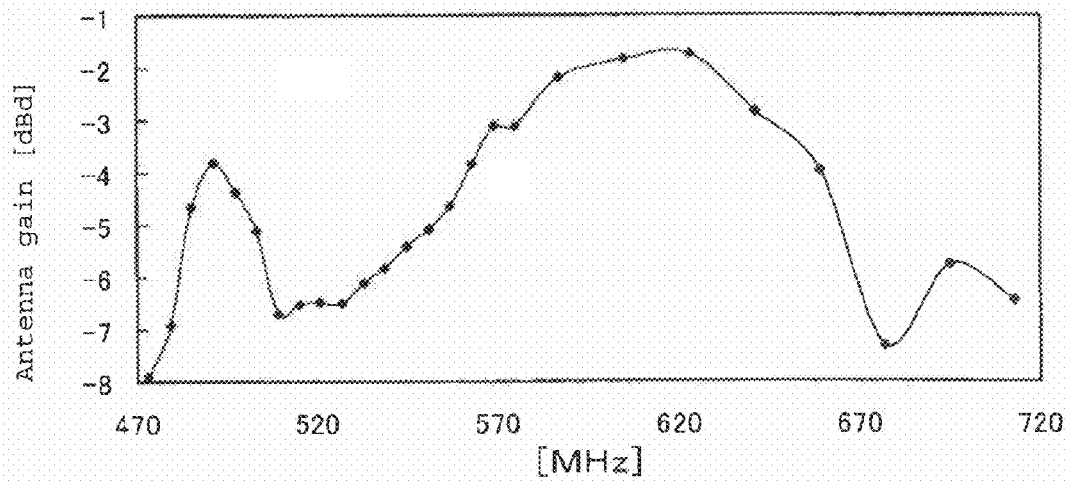

FIG. 12: An antenna gain-frequency characteristic diagram in Example 3.

Figure 13:
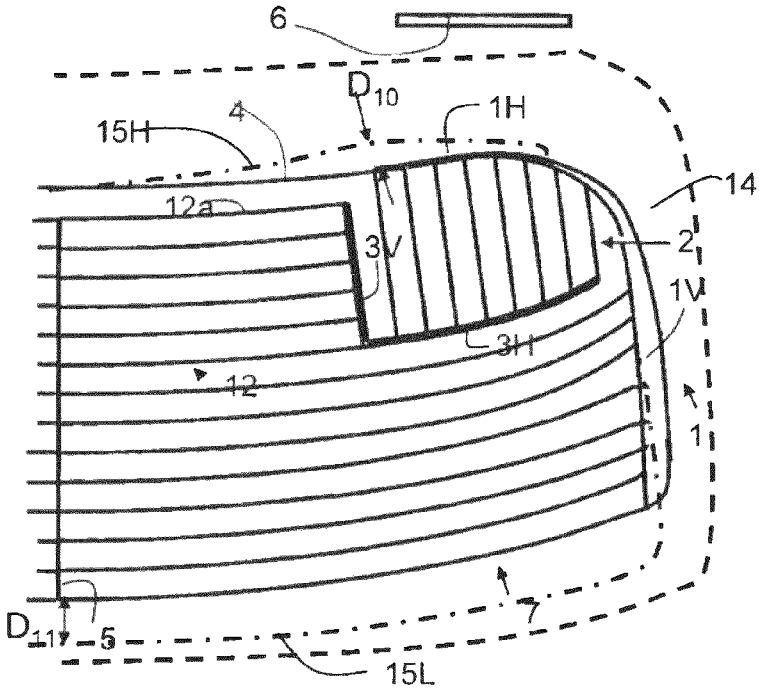

FIG. 13: A front view of a rear glass plate 14 in Example 3.

Figure 14:
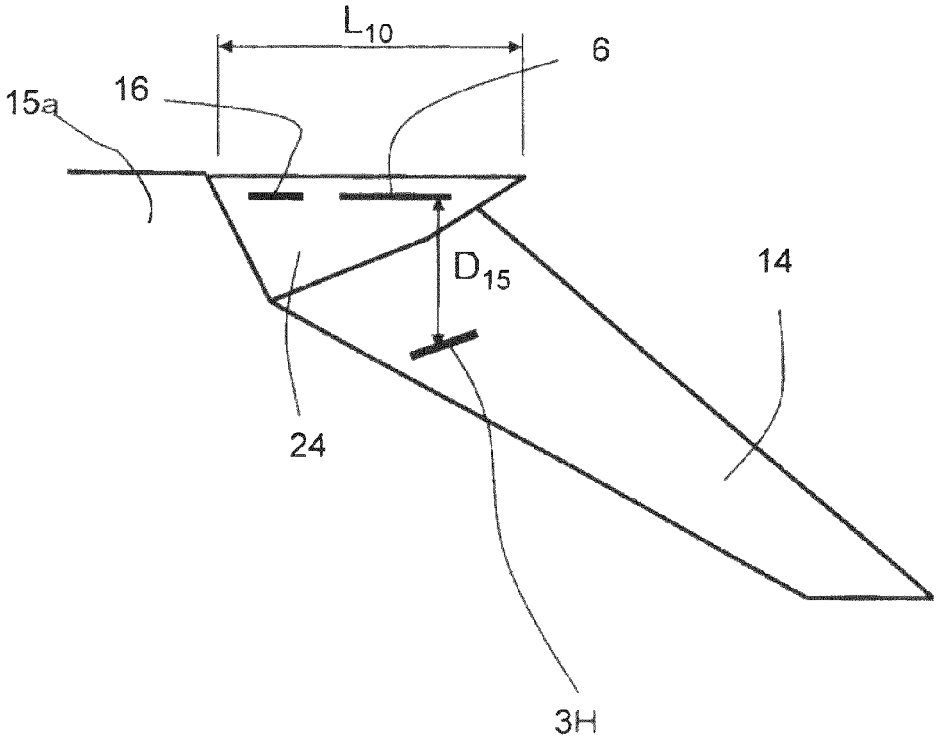

FIG. 14: An enlarged side view in the vicinity of the rear window glass plate 14 shown in FIG. 3 in Example 3.

Figure 15:
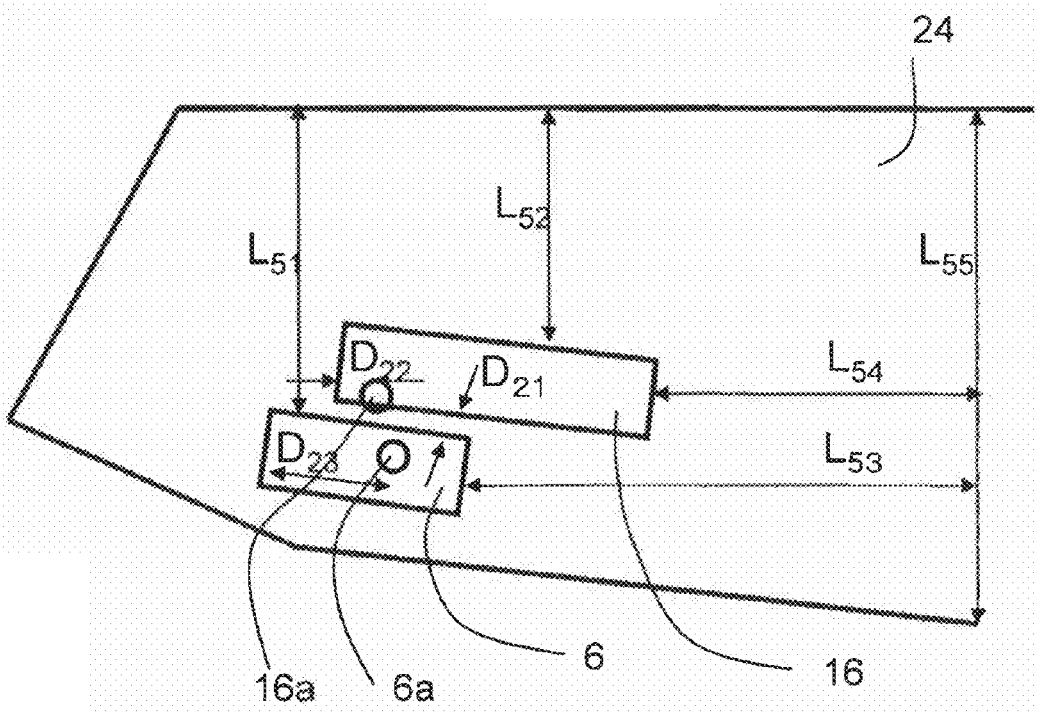

FIG. 15: A plan view showing dimensions of a spoiler 24, an antenna conductor 6 and a ground conductor 16 embedded in the spoiler 24 in Example 3.

EXPLANATION OF NUMERALS

1: Left side bus bar
1H: Bus bar horizontal portion
1K: Bus bar beak-like portion
1V: Bus bar vertical portion
4: Anti-freeze heater wire for wiper
12: Vertical heater wire
3H: Inside horizontal bus bar
3V: Inside vertical bus bar
6: Antenna conductor
7: Heater wire
12: Inside heater wire
12*a*: Inside heater wire at the highest position
14: Rear window glass plate for an automobile
20: Left virtual plane
21: Right virtual plane From now, a high frequency wave glass antenna for an automobile of the present invention is described in detail with reference to suitable embodiments shown in the attached drawings. FIG. 1 (car-interior view or car-exterior view) is a front view showing an embodiment of a high frequency wave glass antenna for an automobile of the present invention. In FIG. 1 and Figures to be described, a direction means a direction on each drawing.

In FIG. 1, 1 indicates a left side bus bar, 1H indicates a bus bar horizontal portion, 1K indicates a bus bar beak-like portion, 1V indicates a bus bar vertical portion, 2 indicates a vertical heater wire, 4 indicates an anti-freeze heater wire for a wiper, 3H indicates an inside horizontal bus bar, 3V indicates an inside vertical bus bar, 5 indicates a short circuit wire, 6 indicates an antenna conductor, 7 indicates a heater wire, 12 indicates an inside heater wire, 12*a* indicates an inside heater wire at the highest position, 14 indicates a rear window glass plate of an automobile, 20 indicates a left virtual plane and 21 indicates a right virtual plane.

FIG. 1 shows a left side region of the rear window glass plate 14. In the example shown in FIG. 1, the left side region and a right side region are symmetric to each other with respect to the left-right center of the rear window glass plate 14. However, the shape is not necessarily limited thereto, and they are not necessarily symmetric to each other.

In the present invention, on the rear window glass plate, a plurality of heater wires and a plurality of bus bars for supplying a power to the heater wires, are provided. The plurality of heater wires and the plurality of bus bars constitute a defogger.

In the example shown in FIG. 1, a part of the plurality of heater wires extend in a horizontal direction or a substantially horizontal direction. The antenna conductor 6 may be provided in a blank region in an upper portion of the rear window glass plate 14 other than the defogger region, or it may be provided in the vicinity of the rear window glass plate 14.

In a case where the antenna conductor 6 is provided in the blank region in the upper portion of the rear window glass plate 14, the antenna conductor 6 is preferably provided at least one of the left side upper blank region or the right side upper blank region, for the reasons of improving directivity and convenience for assembly.

In a case where the antenna conductor 6 is provided in the vicinity of the rear window glass plate 14, the antenna conductor 6 is preferably provided in spoiler provided in the upper rear portion of the automobile body in the vicinity of the rear window glass plate, for the reason of e.g. convenience of assembly. However, the position is not necessarily limited thereto, and the antenna conductor 6 may be attached to a part of the automobile body in the vicinity of the rear window glass plate 14.

In the example shown in FIG. 1, the antenna conductor 6 is a monopole antenna. However, the type of antenna is not necessarily limited thereto, and the antenna may be a dipole antenna having an antenna conductor and a ground conductor (refer to e.g. FIG. 3 to be described later). In a case of employing a dipole antenna, a receive signal between the antenna conductor and the ground conductor is sent to a receiver (not shown).

In the present invention at least one of the plurality of bus bars has a bus bar horizontal portion 1H extending in a horizontal direction or a substantially horizontal direction. The bus bar horizontal portion 1H is provided in the upper region of the rear glass window plate 14. A plurality of vertical heater wires 2 are provided, which extend in a vertical direction or a substantially vertical direction from the bus bar horizontal portion 1H.

In the example shown in FIG. 1, a bus bar 1 has a bus bar vertical portion 1V extending in a vertical direction or a substantially vertical direction in a left side region. The upper portion of the bus bar vertical portion 1V turns towards the left-right center of the rear window glass plate 14, to constitute a bus bar horizontal portion 1H. Further, in the lowermost portion of the bus bar vertical portion 1V, a bus bar beak-like portion 1K extending upwardly in the inside of the defogger is provided. The bus bar beak-like portion 1K has a function of unifying electricity supplied to the heater wires 7, and is provided as the case requires.

Further, below the bus bar horizontal portion 1H, an inside horizontal bus bar 3H extending in a horizontal direction or a substantially horizontal direction is provided, and the inside horizontal bus bar 3H and the bus bar horizontal portion 1H are connected by a plurality of vertical heater wires 2. The vertical heater wires 2 extend in a vertical direction or a substantially vertical direction. The antenna conductor 6 is preferably provided above the bus bar horizontal portion 1H for the reason that the antenna gain can be improved. Further, in order to improve antenna gain, the antenna conductor 6 is preferably provided in at least one of the upper left portion or the upper right portion of the rear window glass plate 14.

Further, an inside vertical bus bar 3V is preferably provided, which extends upwardly from an end of the inside horizontal bus bar 3H in the left-right center side of the rear window glass plate 14 or its vicinity, and internal heater wires 12 are preferably provided, which extend in a horizontal direction or a substantially horizontal direction from the inside vertical bus bar 3V. This is because in such a construction, it becomes possible to defog the left-right central region of the rear window glass plate 14 to maintain visibility. Here, an anti-freeze heater wire 4 for wiper has a function of anti-freeze of wiper when a wiper is provided on the upper portion of the rear window glass plate 14. However, the construction is not necessarily limited thereto, and for example, when no wiper is provided, the heater wire may be used as a heater wire for defogging the rear window glass plate.

A plane parallel with the longitudinal direction and the vertical direction of an automobile, that is tangent to the left end of the antenna conductor 6, is defined as a left virtual plane 20. Further, a plane parallel with the longitudinal direction and the vertical direction of an automobile, that is tangent to a right end of the antenna conductor 6, is defined as a right virtual plane. Then, at least one of the plurality of vertical heater wires is preferably provided between the left virtual plane 20 and the right virtual plane 21 on the rear window glass plate 14, for the reason of improving antenna gain.

In the present invention, the intervals of the plurality of vertical heater wires 2 are preferably from 19 to 39 mm for the reason of defogging performance to maintain visibility. In this region, more preferred region is from 24 to 34 mm, particularly preferred region is from 26 to 32 mm, the most preferred region is from 27.5 to 30.5 mm.

It is preferred that $(D_{LR}/\lambda_g)$ is at least 0.32 and $D_{LR}$ is at most 450 mm provided that the wavelength in the air at a frequency in a desired frequency band to be received by the antenna conductor is designated as $\lambda_0$, the glass wavelength shrinkage ratio is designated as k that is k=0.64, $\lambda_g$ is defined as $\lambda_g=\lambda_0 \cdot k$, and provided that the average distance between the leftmost vertical heater wire and the rightmost vertical heater wire among the vertical heater wires is designated as $D_{LR}$. The value $(D_{LR}/\lambda_g)$ is preferably at least 0.32 to improve an antenna gain as compared with a case where it is less than 0.32. $D_{LR}$ is preferably at most 450 mm for the reasons that an antenna gain can be improved, the bus bar does not become too long and convenience for assembly is maintained as compared with a case where the value exceeds 450 mm.

These values are preferably such that $(D_{LR}/\lambda_g)$ is at least 0.39 and $D_{LR}$ is at most 400 nm, particularly preferably such that $(D_{LR}/\lambda_g)$ is at least 0.45 and $D_{LR}$ is at most 350 nm, the most preferably such that $(D_{LR}/\lambda_g)$ is at least 0.48 and $D_{LR}$ is at most 300 nm.

Provided that the average length of the plurality of vertical heater wires 2 is designated as $L_V$, $(L_V/\lambda_g)$ is preferably from 0.16 to 0.92 for the purpose of improving antenna gain. Within this range, the more preferred range is from 0.23 to 0.84, particularly preferred range is from 0.29 to 0.71.

In the present invention, $\lambda_0$ is preferably a wavelength in an air at a center frequency in a desired frequency band, for the purpose of improving antenna gain in the entire region of the wavelength band.

In a case of receiving entire region of Japanese terrestrial digital TV broadcasting, $\lambda_0$ is preferably a wavelength in an air at a frequency of 620 MHz.

In a case of receiving the present broadcasting region (470 to 600 MHZ) of Japanese terrestrial digital TV broadcasting, $\lambda_0$ is preferably a wavelength in an air at a frequency of 535 MHz.

In a case of receiving the main region (470 to 710 MHz) of Japanese terrestrial digital TV broadcasting, $\lambda_0$ is preferably a wavelength in an air at a frequency of 590 MHz.

FIG. 3 is a side view showing an upper rear side portion of an automobile in an embodiment of high frequency wave glass antenna for an automobile of the present invention, which includes the embodiment shown in FIG. 1. In FIG. 3, 15*a* indicates an upper rear portion of an automobile, 16 indicates a ground conductor, 24 indicates a spoiler, and 25 indicates a rearmost side window glass plate. On a rear window glass plate 14, a defogger portion other than an inside horizontal bus bar 3H is not shown and omitted.

In the example shown in FIG. 3, a spoiler 24 made of an insulative material is provided on an upper rear portion 15*a* of the automobile body. In the spoiler 24, an antenna conductor 6 and a ground conductor 16 are embedded. However, the construction is not necessarily limited thereto, and the construction may be such that at least one of the antenna conductor 6 and the ground conductor 16 is provided on a surface of the spoiler 24. The material of the spoiler 24 is preferably an insulative material, and it may, for example, be a synthesized resin.

Further, the antenna provided on the spoiler 24 is a dipole antenna. However, the antenna is not necessarily limited thereto, and it may be a monopole antenna in which only the antenna conductor 6 is provided in the spoiler 24.

In a case where the antenna conductor 6 is provided in the spoiler, the antenna conductor 6 preferably extends along a surface of a rear window glass for the purpose of improving antenna gain. The minimum distance between a vertical heater wire 2 and the antenna conductor 6 is preferably at most 500 mm, particularly preferably at most 300 mm for the purpose of downsizing and convenience for assembly.

In the present invention, in a case of receiving the digital TV broadcast band, the shape and the size of the is antenna conductor 6 is preferably configured to have a receiving function of digital TV broadcast band, for the purpose of improving antenna gain.

In the present invention, a part or all of the antenna conductor 6 (when the antenna conductor 6 is provided on the rear window glass plate 14) or a part of defogger, may be provided on a shielding film being a dielectric film formed on the rear window glass plate 14. The shielding film may, for example, be a ceramic film such as a black ceramic film. In this case, since e.g. the antenna conductor 6 portion provided on the shielding film is shielded when it is observed from a car-exterior side of the rear window glass plate 14, the rear window glass plate 14 becomes excellent in design which shields the antenna system of the present invention when it is observed from a car-exterior side.

The antenna conductor 6, (when the antenna conductor 6 is provided on the rear window glass plat 14) and the defogger are usually formed by printing a paste such as a silver paste containing an electrically conductive metal on a car-interior surface of the rear window glass plate 14, and baking the paste. However, the forming method is not necessarily limited thereto, and it may be formed by forming a wire-shaped member or a foil-shaped member made of an electrically conductive material such as copper on a car-interior side surface or a car-exterior side surface of the rear window glass plate 14, or it may be embedded inside of the rear window glass plate 14 itself. Further, the antenna conductor 6 may be formed by laminating a synthetic resin film having a conductor layer in the film or on a surface of the film, on a car-interior side surface or a car-exterior side surface of the rear window glass plate 14.

EXAMPLES

From now, the present invention will be described with reference to Examples, but the present invention is not limited to these Examples, and various improvements or modifications are included in the present invention so long as they do not depart from the gist of the present invention.

Examples are described in detail with reference to drawings.

Example 1

Example of the Present Invention

With respect to a high frequency wave antenna for an automobile shown in FIGS. 4 and 5, its antenna gain for horizontal polarization is calculated by a moment method. FIG. 4 is a front view of an upper left side half of a rear portion of an automobile, which is symmetric with respect to a left-right center of the rear window glass plate 14, and no antenna conductor is assumed to be provided in a right half. In FIG. 4, 15 indicates an automobile body, 26 indicates a dipole antenna of 275 mm, and symbols in the vicinity of arrows indicate lengths, distances or intervals.

FIG. 5 is a side view of the high frequency wave antenna for an automobile shown in FIG. 4. In FIG. 5, 15H indicates an upper edge of an automobile body opening for window, and 15L indicates a lower edge of an automobile body opening for window. In FIGS. 4 and 5, no anti-freeze heater wire for wiper is provided. In FIG. 5, symbols in the vicinity of arrows indicate lengths, distances or intervals. Further, a defogger portion other than the inside heater wire 12*a* at the highest portion is omitted and not described.

An antenna gain is defined as an average value of antenna gains at 1° intervals within a horizontal direction range of from −90° to +90° (automobile back side) provided that the automobile rear direction is designated as 0°, the automobile left direction is designated as +90° and the automobile front direction is designated as +180°. The frequencies for calculation is 10 MHz intervals in a range of from 470 to 770 MHz.

In FIG. 4, $H_1$ (parallel direction with the rear window glass plate 14) is fixed to 151 mm (six inside heater wires 12) which maximizes the antenna gain in a frequency range of from 470 to 770 MHz regardless of $W_1$ value, and the antenna gain is calculated as a function of $W_1$. The calculation is made under an assumption that intervals of vertical heater wires 2 are constant (each 29 mm), and that as $W_1$ increases, the length of the internal heater wires 12 decreases, and the number of vertical heater wires increases accordingly. The calculation is made under an assumption that as $W_1$ decreases, the length of the internal heater wires 12 increases, and the number of vertical heater wires decreases accordingly.

As calculation results, antenna gain-$W_1$ characteristic diagrams in respective frequency regions are shown in FIG. 6 (470 to 770 MHz), FIG. 7 (470 to 600 MHz) and FIG. 8 (470 to 710 MHz). Here, provided that $\lambda_0$ is a wavelength in an air at a frequency of 620 MHz, the value of $W_1$ at which $(D_{LR}/\lambda_g)$ becomes 0.32 becomes approximately 100 mm.

Parameters such as dimensions of various portions in FIGS. 4 and 5 are as follows.

| | |
|---|---|
| $D_1$ (parallel direction with rear window glass plate 14) | 50 mm, |
| $D_2$ | 20 mm, |
| $D_3$ | 30 mm, |

-continued

| | |
|---|---|
| $D_4$ | 50 mm, |
| $D_5$ | 30 mm, |
| $W_2$ | 50 mm, |
| $W_3$ (vertical width of an automobile body opening for window) | 500 mm, |
| $L_1$ (parallel direction with rear window glass plate 14) | 30 mm, |
| $L_2$ | 424 mm, |
| $L_3$ | 624 mm, |
| $L_4$ | 50 mm, |
| $L_5$ | 200 mm, |
| Interval between horizontal heater wires 2 | 29 mm, |
| Distance between heater wire 7 at the highest position and inside heater wire 12 at the lowest position | 29 mm, |
| Interval between heater wires 7 and interval between inside heater wires 12 | 29 mm, |
| Line width of vertical heater wire 2, line width of heater wire 7 and line width of inside heater wire 12 | 1 mm, |
| $\alpha$ | 45°, |
| Horizontal width of defogger | 1,300 mm, |
| Horizontal width of automobile body 15 | 1,440 mm, |
| Thickness of metal plate constituting automobile body | 0.75 mm. |

Example 2

Example of the Present Invention

Antenna gain is calculated as a function of $H_1$ in the same manner as Example 1 except that $W_1$ is fixed to 211 mm (eight vertical heater wires 2) maximizing the antenna gain in a frequency range of from 470 to 770 MHz regardless of the value of $H_1$.

When $H_1$ is changed, an interval between vertical heater wires 2, the distance between a heater wire 7 at the highest position and an internal heater wire 12 at the lowest position, an interval between heater wires 7, and an interval between inside heater wires 12, are each set to be constant (29 mm).

The antenna gain is calculated under assumption that as $H_1$ becomes longer, the number of inside heater wires 12 increases accordingly and the number of heater wires 7 decreases accordingly.

The antenna gain is calculated under assumption that as $H_1$ becomes shorter, the number of inside heater wires 12 decreases accordingly and the number of heater wires 7 increases accordingly. Conditions such as dimensions not specified are the same as those of Example 1.

As calculation results, antenna gain-$H_1$ characteristic diagrams in respective frequency ranges are shown in FIG. 9 (470 to 770 MHz), FIG. 10 (470 to 600 MHz) and FIG. 11 (470 to 710 MHz). Here, provided that $\lambda_0$ is a wavelength in the air at a frequency of 620 MHz, the value of $H_1$ at which $(L_V/\lambda_g)$ becomes 0.16, becomes approximately 50 mm.

Example 3

Example of the Present Invention

A high frequency wave antenna for an automobile shown in FIGS. 3, 13 (car-interior view), 14 and 15 was produced. FIG. 14 is a partial enlarged side view in the vicinity of a rear window glass plate 14 shown in FIG. 3, and shows dimensions. FIG. 15 is a plan view showing dimensions of a spoiler 24, an antenna conductor 6 and a ground conductor 16 embedded in the spoiler 24 (in a case where the material of spoiler is transparent), and FIG. 15 shows a left half of the spoiler 24. In FIG. 15, 6*a* indicates a feeding point of the antenna conductor 6, 16*a* indicates a feeding point of the ground conductor. The upper direction in FIG. 15 indicates a forward direction of the automobile. Here, the spoiler 24 is symmetric with respect to the left-right center, and the antenna conductor 6 and the ground conductor 16 were provided also in a right half of the spoiler 24. FIG. 12 shows an antenna gain-frequency characteristic.

An antenna gain was defined as an average value of antenna gains (3° interval) in a horizontal direction range of from −90° to +90° (automobile back side) provided that the automobile rear direction is defined as 0°, the automobile right direction is defined as +90° and the automobile forward direction is defined as +180°. Dimensions of portions of the antenna are as follows.

| | |
|---|---|
| Antenna conductor 6 | 80 × 100 mm, |
| Ground conductor 16 | 40 × 200 mm, |
| Interval between vertical heater wires 2 | 30 mm, |
| Distance between heater wire 7 at the highest position and inside heater wire 12 at the lowest position | 30 mm, |
| Interval between heater wires 7 and interval between inside heater wires 12 | 30 mm, |
| Distance between anti-freeze heater wire 4 and inside heater wire 12a at the highest position | 26 mm, |
| Bus bar vertical portion 1V | 5 to 20 mm, |
| Bus bar horizontal portion 1H | 5 mm, |
| $D_{10}$ | 10 mm, |
| $D_{11}$ | 70 mm, |
| Maximum horizontal width of defogger | 1,200 mm, |
| Line width of anti-freeze heater 4 for wiper, line width of heater wire 7, line width of inside heater wire 12 and line width of short circuit wire 5 | 0.7 mm, |
| Line width of vertical heater wire 2 | 0.4 mm. |
| $L_{10}$ | 370 mm, |
| $D_{15}$ | 140 mm, |
| $D_{21}$ | 20 mm, |
| $D_{22}$ | 15 mm, |
| $D_{23}$ | 55 mm, |
| $L_{51}$ | 230 mm, |
| $L_{52}$ | 190 mm, |
| $L_{53}$ | 385 mm, |
| $L_{54}$ | 220 mm, |
| $L_{55}$ | 370 mm, |
| Rear window glass plate 14 | 600 × 1,400 mm. |

The present invention is used for a glass antenna for an automobile for receiving terrestrial digital TV broadcasting, analogue TV broadcasting in UHF band, digital TV broadcasting in U.S., digital TV broadcasting in EU region, or digital TV broadcasting in Peoples Republic of China. Further, the present invention is usable also for receiving FM broadcasting band in Japan (76 to 90 MHz), FM broadcast band in U.S. (88 to 108 MHz), VHF band for TV (90 to 108 MHz, 170 to 222 MHz), 800 MHz band for automobile phone (810 to 960 MHz), 1.5 GHz band for automobile phone (1.429 to 1.501 GHz), UHF band (300 MHz to 3 GHz), GPS (global positioning system), or GPS signal of satellite (1,575.42 MHz).

Further, the present invention is usable for DSRC (Dedicated Short Range Communication, 915 MHz band) or communication for automobile keyless entry system (300 to 450 MHz).

The entire disclosure of Japanese Patent Application No. 2007-179706 filed on Jul. 9, 2007 including specification, claims, drawings and summary is incorporated herein by reference in its entirety.

What is claimed is:

1. A high frequency wave antenna for an automobile, comprising:

a glass plate configured to be mounted as a rear window of an automobile and having a plurality of heater wires and a plurality of bus bars for supplying electricity to the plurality of heater wires, the heater wires and the bus bars constituting a defogger for the rear window; and an antenna conductor configured to receive a high frequency wave and provided on an upper blank space of the glass plate, wherein the plurality of bus bars includes one having a bus bar horizontal portion extending in a horizontal direction or a substantially horizontal direction in an upper region of the glass plate and below the upper blank space, the plurality of heater wires includes a plurality of horizontal heater wires extending in a horizontal direction or a substantially horizontal direction and a plurality of vertical heater wires extending in a vertical direction or a substantially vertical direction, the vertical heater wires are extending from the bus bar horizontal portion, the plurality of horizontal heater wires includes ones positioned below the vertical heater wires and ones positioned on a side of the vertical heater wires, and the antenna conductor is positioned above the vertical heater wires in the upper blank space of the glass plate.

2. The high frequency antenna for an automobile according to claim 1, wherein the one of the bus bars has a bus bar vertical portion extending in a vertical direction or a substantially vertical direction, and the bus bar vertical portion is connected to the bus bar horizontal portion at an upper end of the bus bar vertical portion.

3. The high frequency wave antenna for an automobile according to claim 1, wherein the plurality of bus bars includes an inside horizontal bus bar extending in the horizontal direction or the substantially horizontal direction below the bus bar horizontal portion, the inside horizontal bus bar is facing the bus bar horizontal portion, and the plurality of the vertical heater wires is extending between the bus bar horizontal portion and the inside horizontal bus bar.

4. The high frequency wave antenna for an automobile according to claim 3, wherein the plurality of bus bars includes an inside vertical bus bar extending in a vertical direction or a substantially vertical direction the ones of the heater wires on the side of the vertical heater wires extend from the inside vertical bus bar.

5. The high frequency wave antenna for an automobile according to claim 1, wherein at least one of the heater wires is provided between a left virtual plane and a right virtual plane and on the rear window glass plate provided that a plane parallel with the longitudinal direction and the vertical direction of the automobile, that is tangent to the left end of the antenna conductor, is designated as the left virtual plane, and a plane parallel with the longitudinal direction and the vertical direction of the automobile, that is tangent to the right end of the antenna conductor, is designated as the right virtual plane.

6. The high frequency wave glass antenna for an automobile according to claim 1, wherein the plurality of vertical heater wires has an interval from 19 to 39 mm.

7. The high frequency wave antenna for an automobile according to claim 1, wherein $(D_{LR}/\lambda_g)$ is at least 0.32 and $D_{LR}$ is at most 450 mm provided that $\lambda_g$ is defined as $\lambda_g=\lambda_0 \cdot k$, $D_{LR}$ is an average distance between the leftmost vertical heater wire and the rightmost vertical heater wire in the vertical heater wires, $\lambda_0$ is a wavelength in the air at a frequency in a desired frequency band to be received by the antenna conductor, and k is a glass wavelength shrinkage ratio and is k=0.64.

8. The high frequency antenna for automobiles according to claim 1, wherein $(L_V/\lambda_g)$ is from 0.16 to 0.92 provided that $\lambda_g$ is defined as $\lambda_g=\lambda_0 \cdot k$, $L_V$ is an average wire length of the vertical heater wires, $\lambda_0$ is a wavelength in the air at a frequency in a desired frequency band to be received by the antenna conductor, and k is a glass wavelength shrinkage ratio and is k=0.64.

9. The high frequency wave glass antenna for an automobile according to claim 7, wherein $\lambda_0$ is a wavelength in the air at a center frequency in the desired frequency band.

10. The high frequency wave glass antenna for an automobile according to claim 8, wherein $\lambda_0$ is a wavelength in the air at a center frequency in the desired frequency band.

11. The high frequency wave glass antenna for an automobile according to claim 1, wherein the antenna conductor has a shape and a dimension configured to receive a digital TV broadcast band.

12. The high frequency wave glass antenna for an automobile according to claim 1, wherein the antenna conductor is configured to receive a frequency between 470 and 770 MHz.

13. The high frequency wave glass antenna for an automobile according to claim 1, wherein the antenna conductor is configured to receive a frequency between 698 and 806 MHz.

14. A rear window glass for an automobile, comprising:

a glass plate configured to be mounted as a rear window of an automobile; and a defogger formed on the glass plate and comprising a plurality of heater wires and a plurality of bus bars for supplying electricity to the plurality of heater wires, wherein the plurality of bus bars includes one having a bus bar horizontal portion extending in a horizontal direction or a substantially horizontal direction in an upper region of the glass plate, the plurality of heater wires includes a plurality of horizontal heater wires extending in a horizontal direction or a substantially horizontal direction and a plurality of vertical heater wires extending in a vertical direction or a substantially vertical direction, the vertical heater wires are extending from the bus bar horizontal portion, and the plurality of horizontal heater wires includes ones positioned below the vertical heater wires and ones positioned on a side of the vertical heater wires.

15. The rear window glass for an automobile according to claim 14, wherein the plurality of bus bars includes an inside bus bar extending in the horizontal direction or the substantially horizontal direction below the bus bar horizontal portion, the inside horizontal bus bar is facing the bus bar horizontal portion, and the plurality of the vertical heater wires is extending between the bus bar horizontal portion and the inside horizontal bus bar.

16. An automobile comprising:

a rear window glass according to claim 14;

a spoiler provided in an upper rear portion of an automobile body above the rear window glass; and an antenna conductor provided in the spoiler.

17. The automobile according to claim 16, herein the antenna conductor extends along a surface of the rear window glass.

18. An automobile comprising:

a rear window glass according to claim 15;

a spoiler provided in an upper rear portion of an automobile body above the rear window glass; and an antenna conductor provided in the spoiler.

19. The automobile according to claim 18, wherein the antenna conductor extends along a surface of the rear window glass.

* * * * *